United States Patent [19]

Nordberg

[11] Patent Number: 4,702,699

[45] Date of Patent: Oct. 27, 1987

[54] TARGET IMAGE PRESENTATION SYSTEM

[75] Inventor: Anthony Nordberg, Sussex, England

[73] Assignee: GQ Defence Equipment Limited, Surrey, England

[21] Appl. No.: 705,876

[22] Filed: Feb. 26, 1985

[30] Foreign Application Priority Data

Mar. 2, 1984 [GB] United Kingdom ..... 8405519

[51] Int. Cl.[4] ..... F41J 5/10

[52] U.S. Cl. ..... 434/20; 352/131

[58] Field of Search ..... 434/20, 44; 352/131, 352/132, 169

[56] References Cited

U.S. PATENT DOCUMENTS

| | | | |
|---|---|---|---|
| 3,774,990 | 11/1973 | Beck et al. | 434/44 |
| 3,924,342 | 12/1975 | Pedlar et al. | 434/43 |
| 4,235,535 | 11/1980 | Prinz et al. | 434/44 |
| 4,390,253 | 6/1983 | Lobb | 434/44 |

*Primary Examiner*—Leo P. Picard

*Attorney, Agent, or Firm*—Kenyon & Kenyon

[57] ABSTRACT

A target image presentation system for displaying images of a target on the interior surface of a part-spherical dome to provide for an observer within the dome a visual representation of an aerial target flying a predetermined flight profile within an airspace surrounding the observer comprises a projector for projecting an image carrying beam carrying images of the target for projection on to the dome and an image beam deflection assembly for so deflecting the image carrying beam as to direct the target images carried thereby to positions on the dome corresponding to the positions of the aerial target flying the predetermined flight profile in the airspace represented by the dome. The image beam deflection assembly is of such a construction that when deflecting the beam it introduces a rotation of the image about the beam axis and the projector is arranged to generate target images which are oriented to compensate for image rotation by the image beam deflection assembly so that the images when projected on to the dome by the image deflection assembly have line of sight orientations corresponding to those which would be viewed by an observer during the flight of the target in the predetermined flight profile.

5 Claims, 5 Drawing Figures

TARGET IMAGE PRESENTATION SYSTEM

The present invention relates to target image presentation systems and is particularly although not exclusively concerned with a target image presentation system in which the image of a target is provided on a cinematograph film and is projected on to a screen by a cinematograph projector.

In a target acquisition training system which has been proposed, a target image presentation system displays images of a target aircraft on the interior surface of a part-spherical dome in such a manner as to provide for an observer within the dome a visual representation of an aircraft flying a predetermined flight profile within an air space surrounding the observer. The target image presentation system includes a cinematograph projector which projects an image carrying beam carrying target images corresponding to those which would be viewed by a ground observer within the dome during the flight of the aircraft in the predetermined flight profile and an image beam deflection assembly for so deflecting the image carrying beam as to direct the target images carried thereby to positions on the dome corresponding to the positions of the aircraft traversing the air space represented by the dome.

The image beam deflection assembly in the system proposed comprises an azimuth deflection assembly for deflecting the image carrying beam in azimuth on the dome and an elevation deflection assembly for deflecting the image carrying beam in elevation on the dome. The azimuth deflection assembly comprises a first inclined reflecting element which directs the image carrying beam from the projector into a vertical path and a second inclined reflecting element which redirects the vertically directed beam into a horizontal path and which is mounted in a rotatable head for rotation about the axis of the vertically directed beam to vary the azimuth of the image on the dome. The elevation deflection assembly then comprises a third reflecting element which is carried by the rotatable head for redirecting the image carrying beam in the horizontal path into a path at right angles to the horizontal path and which is rotatable about the axis of the beam in the horizontal path to vary the elevation of the image on the dome.

The rotations of the second and third reflecting elements in producing the desired azimuth and elevation of the target image on the dome give rise to undesirable rotations of the image about the beam axis. To compensate for these image rotations a derotation prism such as a Dove prism is mounted in the path of the image carrying beam for rotation about the axis of the beam and is arranged to be rotatably driven in response to a derotation signal derived from azimuth and elevation signals applied to drive the rotatable head and third reflecting element.

The addition of a rotatably mounted derotation prism and the drive for it adds to the complexity of the image beam deflection assembly and there is a further disadvantage that it reduces image quality.

It is an object of the present invention to provide a target image presentation system which utilises an image beam deflection assembly of a construction producing image rotation about the beam axis, but which does not require the use of a derotation prism to compensate for the rotation.

According to a first aspect of the present invention there is provided a target image presentation system for displaying images of a target on the interior surface of a part-spherical dome to provide for an observer within the dome a visual representation of an aerial target flying a predetermined flight profile within an airspace surrounding the observer comprising projection means for projecting an image carrying beam carrying images of the target for projection on to the dome, and an image beam deflection assembly for so deflecting the image carrying beam as to direct the target images carried thereby to positions on the dome corresponding to the positions of the aerial target flying the predetermined flight profile in the airspace represented by the dome, the image beam deflection assembly being of a construction which when deflecting the beam introduces a rotation of the image about the beam axis and the projection means including target image generating means for generating target images which are to be projected by the beam and which are oriented to compensate for image rotation by the image beam deflection assembly so that the images when projected on to the dome by the image deflection assembly have line of sight orientations corresponding to those which would be viewed by an observer during the flight of the target in the predetermined flight profile.

In an embodiment of the invention, hereinafter to be described, the projection means comprises a cinematograph projector and the target image generating means comprises a cinematograph film of a target flying a predetermined flight profile, with the film bearing on successive frames images of the target at orientations which compensate for image rotation by the image beam deflection assembly so that the images when projected on to the dome have line of sight orientations corresponding to those which would be viewed by an observer during the flight of the target in the predetermined flight profile.

The cinematograph film may with advantage be produced by displaying a model of the target and producing from the model images on the film under the control of a film production program. The film production program produces from data of the target's position and orientation with respect to the earth's axis at fixed intervals of time throughout the flight profile a script for the line of sight (LOS) heading, pitch and roll for a film production operator to use for orientation of the model and includes a sub-routine to modify the LOS heading pitch and roll values to compensate for image rotation provided by the image beam deflection assembly.

According to a second aspect of the present invention there is provided a cinematograph film of a target flying a predetermined flight profile for use in a target image presentation system according to the first aspect of the invention, wherein successive frames of the film bear images of the target at orientations which compensate for image rotation by the image beam deflection assembly so that the images when projected on to the dome have line of sight orientations corresponding to those which would be viewed by an observer during the flight of the target in the predetermined flight profile.

According to a third aspect of the present invention there is provided a method of producing a cinematograph film for use in a target image presentation system according to the first aspect of the invention comprising the steps of displaying a model of the target and producing on successive frames of a cinematograph film images of the model oriented to compensate for image rotation by the image beam deflection assembly so that the images when projected on to the dome have line of sight orientations corresponding to those which would be viewed by an observer during the flight of the target in the predetermined flight profile.

Preferably, the film is produced by the steps of first producing on a first photographic film images of the model in a manner such that different frames of the film display images of the model at different orientations which compensate for image rotation produced by the image beam deflection assembly and then photographing onto successive frames of a second photographic film the target images carried on the frames of the first film to produce a sequence of images on the second film, whilst adjusting the sizes of the images on the frames of the second film to simulate variations in the range of the target from the observer.

One embodiment of the invention will now be described by way of example with reference to the accompanying drawings in which.

Figure 1:
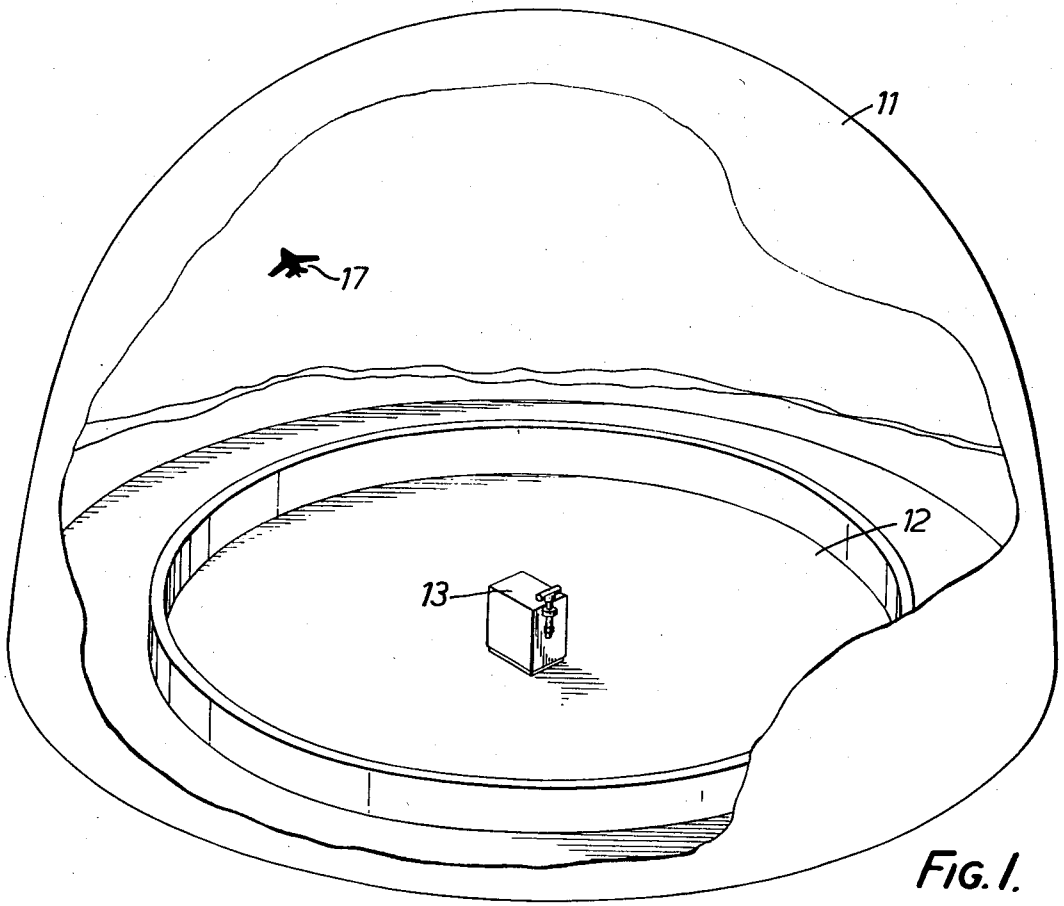
FIG. 1 is a schematic perspective view of a gunnery training installation employing a target image presentation system according to the first aspect of the invention.
Figure 2:
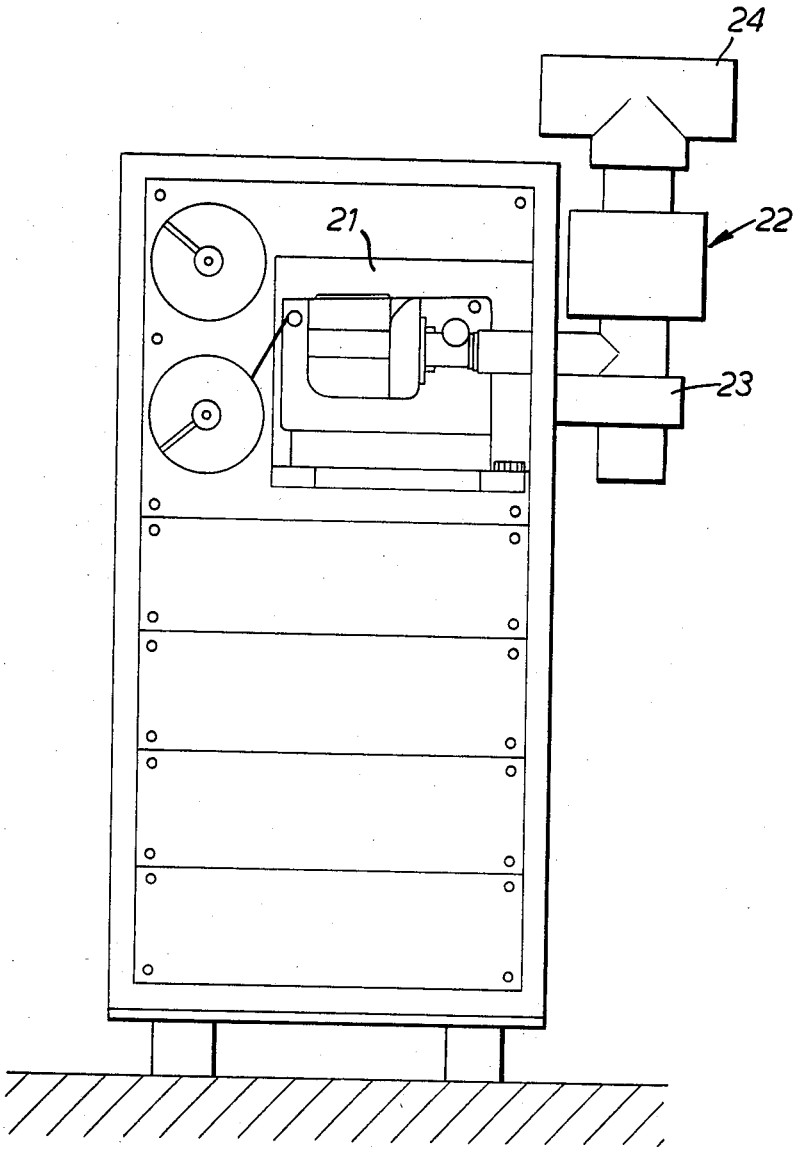
FIG. 2 is a schematic elevation of the target image presentation system employed in the installation shown in FIG. 1.

Referring first to FIG. 1, the installation shown comprises a part-spherical dome 11 having a floor 12 on which is positioned a target image presentation unit 13 to provide for a trainee gunner within the dome a target aircraft image 17 simulating an aircraft flying a predetermined flight profile within the surrounding air space. To provide a realistic environment for the trainee gunner a plurality of slide projectors (not shown) are employed to produce on the interior surface of the dome background scenic images and a plurality of lighting systems (not shown) are employed to produce a realistic and variable sky illumination. The target image presentation unit 13 takes the form illustrated in FIG. 2 and comprises a stationary cinematograph projector 21 for projecting in an image carrying beam target aircraft images from cinematograph film and a target image beam deflection assembly 22 for directing the image carrying beam to positions on the dome corresponding to those of the aircraft flying the appropriate profile. The image deflection assembly 22 comprises a support column 23 and an image deflection head 24 rotatable on the column 23 about the vertical axis of the column.

Figure 3:
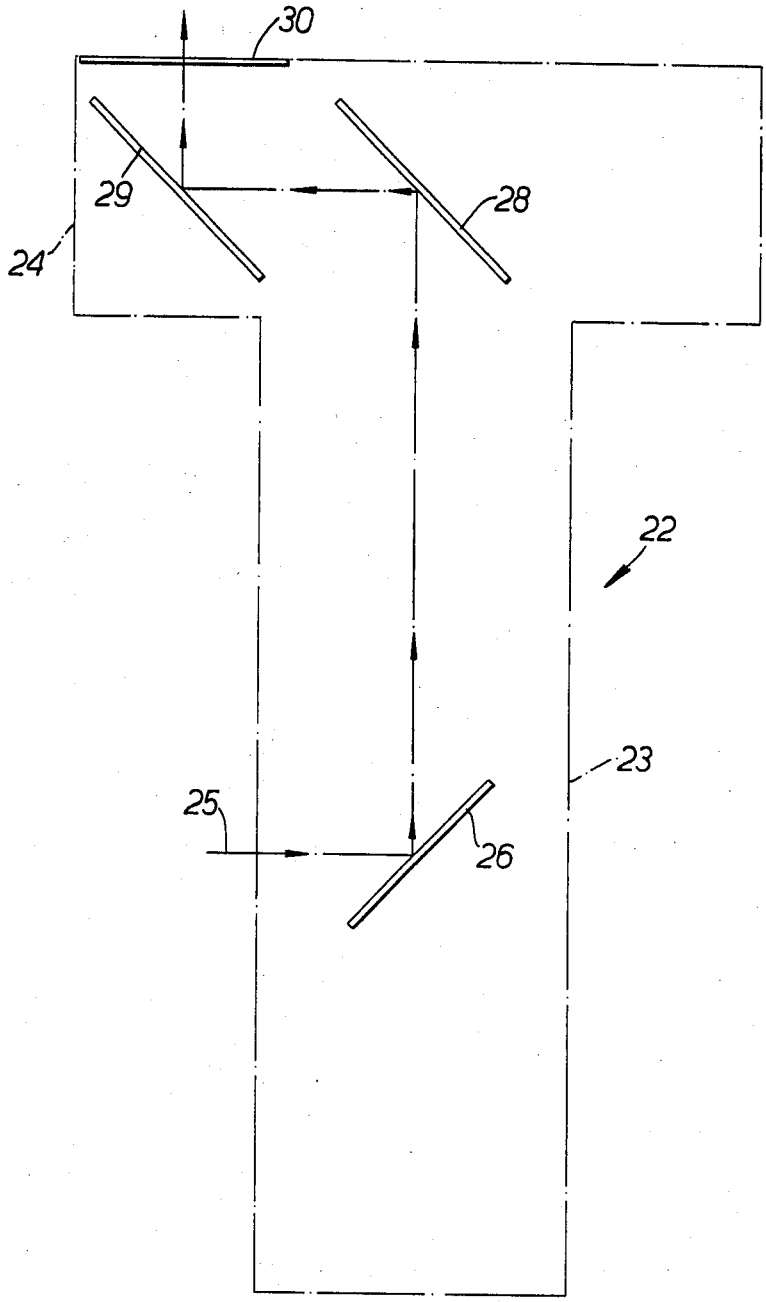
FIG. 3 is a diagrammatic elevation showing in more detail the target image deflection assembly illustrated in FIG. 2.

The image deflection assembly 22 is diagrammatically illustrated in FIG. 3, which shows the path taken by an image carrying beam 25 directed into the assembly 22 from the projector 21. As will be seen, the image carrying beam 25 is redirected into a vertical path along the axis of the column 23 by a first reflecting element 26. It is then redirected back into a horizontal path by a second reflecting element 28 fixedly mounted in the deflection head 24. The beam is then redirected again into a path at right angles to the horizontal path by a third reflecting element 29 which is rotatably mounted in the deflection head 24 for rotation about the axis of the image carrying beam directed thereto. The beam reflected from the element 29 passes through a window 30 and projects the image on to the dome. Rotation of the deflection head 24 about the vertical axis of the column 23 causes a change in the azimuth of the image projected onto the dome while the rotation of the reflecting element 29 about the horizontal beam axis causes a change in the elevation of the image on the dome. The rotation of the head 24 and the reflecting element 29 is controlled by servo motors fed with control signals to bring the projected image to the required azimuth and elevation during the flight profile.

It will be apparent that rotations of the reflecting elements 28 and 29 in producing the desired azimuth and elevation of the target image on the dome 11 give rise to rotations of the target image about the beam axis. To compensate for such image rotations a derotation prism has hitherto been mounted in the path of the image carrying beam 25 for rotation about the axis of the beam, the derotation prism being driven in response to a derotation signal derived from azimuth and elevation control signals applied to drive the servo motors for the head 24 and the reflecting element 29.

The addition of a rotatably mounted derotation prism and the drive for it, however, adds to the complexity of the image beam deflection assembly and there is a further disadvantage that it reduces image quality. The present invention overcomes these disadvantages by compensating for the image rotation in a way which does not require the use of a derotation prism. In particular, the cinematograph film employed in the target image presentation unit 13 is so produced that it bears on successive frames target images which have been pre-oriented to compensate for image rotation by the image beam deflection assembly 22.

A cinematograph film carrying images which compensate for image rotation may with advantage be produced by a method which is now to be described with reference to FIGS. 4 and 5 which comprises the steps of first producing on a first photographic film images of the model in a manner such that different frames of the film display images of the model at different orientations which compensate for image rotation by the image beam deflection assembly and then photographing onto successive frames of a second photographic film the target images carried on the frames of the first film to produce a sequence of images on the second film, whilst adjusting the sizes of the images on the frames of the second film to simulate variations in the range of the target from the observer.

Figure 4:
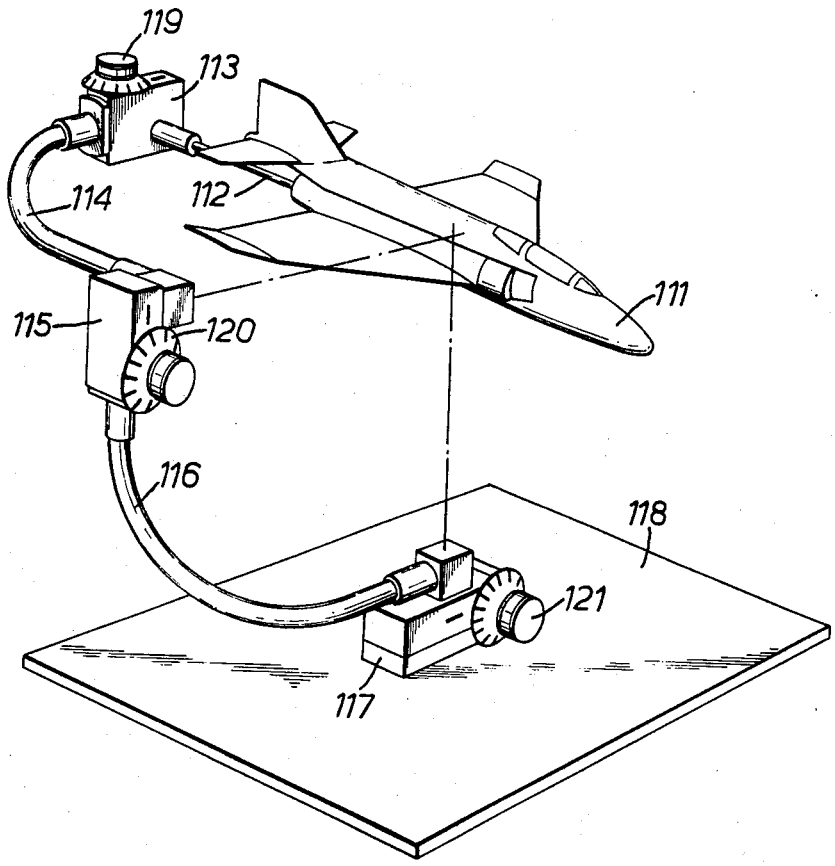
FIG. 4 is a schematic perspective view of a model aircraft mounted on a gimballed support structure for use in the method of producing cinematograph film according to the second aspect of the invention.

Referring to FIG. 4, a model 111 of an aircraft whose flight in a predetermined flight profile is to be represented on a cinematograph film is tail mounted on an output shaft 112 of a gearbox 113, which is in turn mounted by means of an angle bar 114 on the output shaft of a further gearbox 115 likewise mounted by an angle bar 116 on the output shaft of a further gearbox 117 fixedly mounted on a base plate 118. Each of the gearboxes 113,115 and 117 have input shafts which can be turned by hand knobs 119,120 and 121 to cause rotation of their output shafts. As will be seen from FIG. 4, the angular disposition of the model 111 about its roll axis can be changed by rotation of the output shaft 112 under the control of the control knob 119. The angular disposition of the model 111 about its pitch axis can likewise be changed by rotation of the output shaft of the gearbox 115 under the control of the control knob 120. The angular disposition of the model 111 about its yaw axis can be changed by rotation of the output shaft of the gearbox 117 under the control of the knob 121.

The gear ratio of the pitch controlling gearbox 115 is 100:1 in order to provide sufficient frictional torque to prevent rotation due to gravity. The roll and yaw controlling gearboxes 113 and 117 are arranged to have ratios of 10:1. The gearbox 117 may if necessary be fitted with an extension arm and a remote control knob to facilitate its operation. A 0°-360° direct reading analogue dial is fitted to the output shaft of each gearbox.

A first camera (not shown), which may be a single lens reflex camera, is mounted on a camera mount in a position in which it views head on the model 111 as shown in FIG. 4. The camera is specially modified to provide for the accurate positioning of each frame of the film in relation to the camera aperture. In particular, film frame registration pins are located on the hinged rear coverplate of the camera and are movable toward the film plate over the camera aperture. The ends of the pins are tapered so that they easily enter sprocket holes in the film at the camera aperture and when extended fully through the sprocket holes align each frame of the film at exactly the same position for exposure, with the film frame positioned such that the edges of the frame and centre conform exactly to those of the camera aperture.

Successive frames are exposed with the model 111 at predetermined LOS roll, pitch and yaw attitudes. A further model identical to the model 111 shown in FIG. 4 is then nose-mounted on to the output shaft 112 of the gearbox 113 and further film frames exposed with the nose-mounted model at predetermined roll, pitch and yaw attitudes. The exposed film is then processed and each frame mounted in slides, which carry their own registration pins enabling the sprocket holes of each film frame to be aligned exactly in the same position in the slide as it was positioned in the camera.

The images carried by the slide mounted frames are next copied on to 16 mm cinematograph film. For this purpose, a second camera, in the form of a 16 mm pin-registered precision rostrum camera, is mounted vertically above a slide support structure for supporting the slide to be copied. The slides are copied in turn on to the 16 mm film in the required sequence and at each copying operation the height of the rostrum camera above the slide is so adjusted that the size of the copied image takes account of the range of the aircraft at that position in its flight profile, as determined by the slide being copied. The rostrum camera is used to produce a 16 mm film strip master for each of several aircraft flight profiles. The several film strip masters are then processed and edited in a film processing laboratory.

Clearly, the step of calculating the required roll, pitch and yaw orientation settings of the model for the roll pitch and yaw gearboxes 113,115 and 117 in the production of the slides is time-consuming. Furthermore, calculation of appropriate range settings for use with the second camera is also time-consuming. Accordingly, scripts for the operator to use in setting the gearboxes 113,115 and 117 and the position of the second camera are produced by computing apparatus now to be described with reference to FIG. 5.

Figure 5:
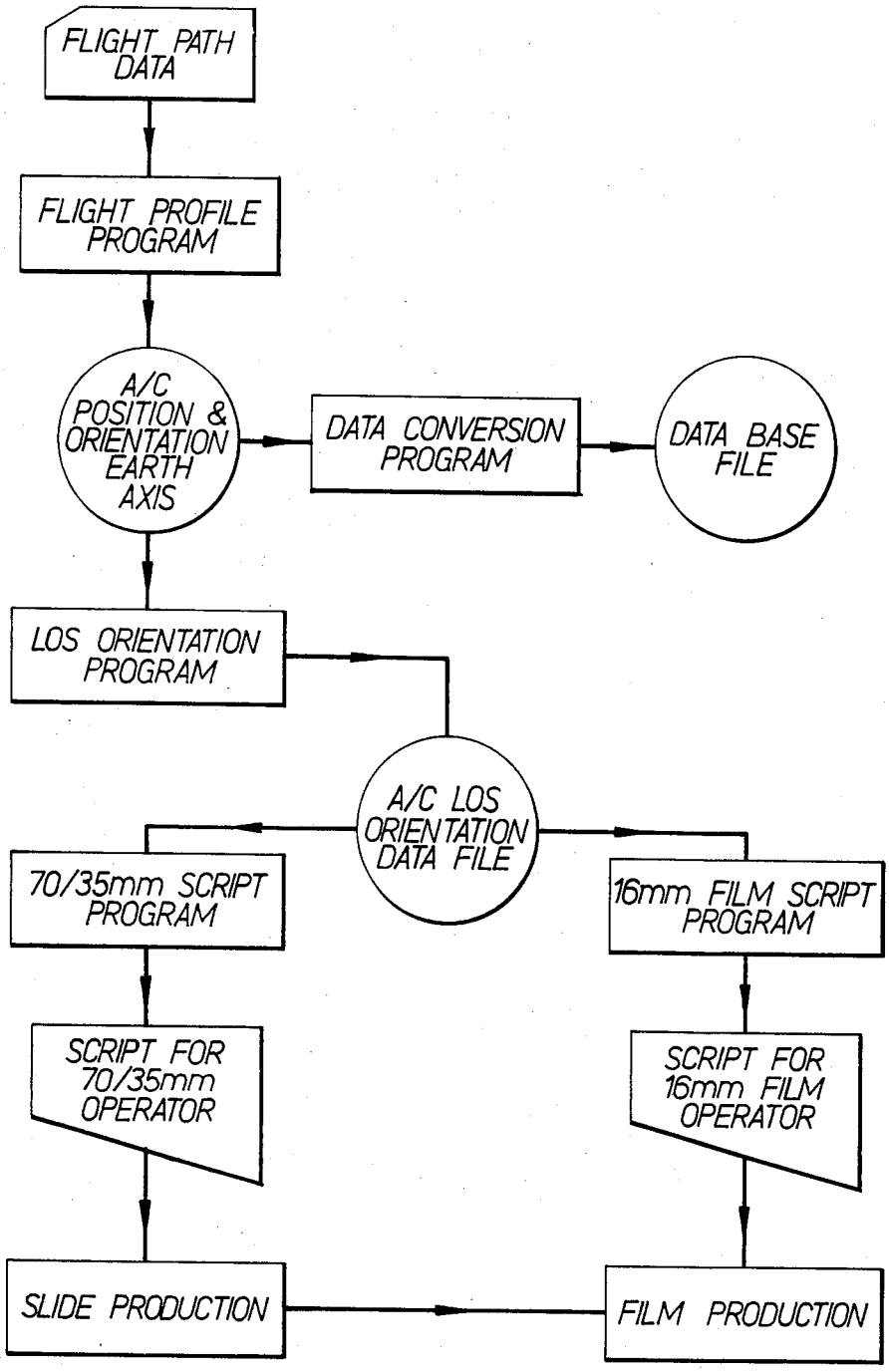
FIG. 5 is a flow chart setting out the steps in generating operator scripts for use in the method of producing cinematograph film according to the third aspect of the invention.

Referring now to FIG. 5, there are four stages involved in the production of the film. The first stage involves the running of a flight profile program, the second stage involves the running of a film production program which generates the shooting scripts for the profile, the third stage is the photographic process which is carried out as hereinbefore described and the fourth stage is the collation of the several flight profile masters into a single length of cinematograph film, followed by coding of the film.

The flight profile program is run to create a data file containing the aircraft's position and orientation, with respect to the earth's axis, at fixed intervals of time during its flight. This program is capable of representing all the basic flight profiles of a modern attack/offensive support aircraft. The input to the program is flight path data containing the aircraft's start position and subsequent manoeuvres during its flight.

The film production program is run to generate the shooting scripts for the profile. There are three sections to this program as follows:

(1) A first section calculates the aircraft's slant range and aircraft orientation along a line of sight (LOS) at fixed time intervals along the flight path. The output from this is time, slant range, aircraft LOS heading, aircraft LOS pitch and aircraft LOS roll.

(2) A second section outputs the script for the operator of the first camera to use with the model orientation assembly shown in FIG. 4. This section includes a subroutine to modify the aircraft LOS heading pitch and roll values to compensate for image rotation introduced by the image beam deflection assembly 22. This section also contains an algorithm for detecting when the model's orientation has changed sufficiently to justify a new slide to be produced.

(3) A third section outputs the script for the 16 mm camera operator. This program contains an algorithm for detecting when the aircraft's slant range has changed sufficiently to justify a change in the size of the image to be transferred from the slide to the 16 mm cinematograph film frame.

The sub-routine used to modify the LOS heading, pitch and roll values to compensate for image rotation by the image beam deflection assembly 22 utilises the following equations:

$$\theta' = \tan^{-1}\left[\cos\alpha\tan\theta - \frac{\sin\alpha\tan\Psi}{\cos\theta}\right]$$

$$\Psi' = \tan^{-1}\left[\left(\sin\alpha\tan\theta + \frac{\tan\Psi\cos\alpha}{\cos\theta}\right)\cos\theta'\right]$$

$$\lambda' = \alpha\cdot\cos\theta.$$

where $\theta$ is the heading at a datum position of the target sight line $\psi$ is the pitch at the datum position of the target sight line $\alpha$ is the angle through which the target sight line is rotated by the assembly 22 from the datum position to a new position $\theta'$ is the new heading at the new position resulting from image rotation $\psi'$ is the new pitch at the new position resulting from image rotation $\lambda'$ is the new roll at the new position resulting from image rotation The sub-routine computes the values $\theta'$, $\psi'$ and $\lambda'$, from the above equations and applies them to modify the aircraft LOS heading, pitch and roll values obtained from the LOS orientation data file. The modified values are then used to generate the script for the camera operator to use in setting the orientation of the model shown in FIG. 4.

As hereinbefore described, two identical models of the target aircraft are employed. One model is tail-mounted as illustrated in FIG. 4 of the drawings while the other is nose-mounted. The computing apparatus is programmed to select the appropriate model to be photographed by the first camera in the production of the slides.

The final cinematograph film bearing the flight profiles is provided with a black continuous optical sound track which extends over the whole of that portion of the film which will be projected. This enables the projector to detect the zero frame position and the starting point for a frame counter and to stop the film and prevent it running off the spools.

I claim:

1. A target image presentation system for displaying images of a target on the interior surface of a part-spherical dome to provide to an observer at a predetermined position within the dome a visual representation of an aerial target flying a predetermined flight profile within an airspace surrounding the observer, the system including:

means for providing images of the aerial target in a sequence of changing target orientations corresponding to the predetermined flight profile as viewed from the position of said observer inside the dome;

means for projecting in a fixed direction a light beam carrying said images, said beam having an axis;

means located in the path of the beam between the projecting means and the interior surface of the dome for deflecting the image-carrying light beam to direct the target images carried thereby to successive positions on the dome corresponding to positions of the aerial target flying the predetermined flight profile in the airspace represented by the dome, said deflecting means inherently causing a rotation of the images about the beam axis as a function of the amount of beam deflection, wherein the improvement comprises:

said target image providing means including means for generating target images that are pre-oriented in such a manner as to compensate for subsequent image rotation about the beam axis by the image beam deflection means, such that the images when projected onto the dome via said image beam deflection means have line of sight orientations corresponding to those which would be viewed from the position of said observer during the flight of an actual target following the predetermined flight profile.

2. A system according to claim 1, wherein the projection means comprises a cinematograph projector, wherein the target image providing means comprises a cinematograph film of a target, and wherein the film bears on successive frames images of the target at orientations which pre-compensate for said subsequent image rotation by the image beam deflection means so that the cinematograph images when projected onto the dome have line of sight orientations corresponding to those that would be viewed from the position of the observer during the flight of an actual target following the predetermined flight profile.

3. A system according to claim 2, wherein the cinematograph film contains images of the target that were produced by a film production program, the position and orientation of the target with respect to the earth's axis over fixed intervals of time through the flight profile comprising the basis of data used by said program to produce a script of LOS heading, pitch, and roll values used to orient a model from which images of the target were generated; the program including a subroutine to modify the LOS heading, pitch, and roll values so as to pre-compensate for image rotation to be subsequently caused by the image beam deflection means.

4. A system according to claim 2, wherein the image beam deflection means comprises an azimuth deflection means for deflecting the image carrying beam in azimuth on the dome and an elevation deflection means for deflecting the image carrying beam in elevation on the dome.

5. A system according to claim 4, wherein the azimuth deflection means comprises a first inclined reflecting element which directs the image carrying beam from the projector into a vertical path and a second inclined reflecting element which redirects the vertically directed beam into a horizontal path and which is mounted in a rotatable head for rotation about the axis of the vertically directed beam to vary the azimuth of the image on the dome, and wherein the elevation deflection means comprises a third reflecting element which is carried by the head for redirecting the image carrying beam in the horizontal path into a path at right angles to the horizontal path and which is rotatable about the axis of the beam in the horizontal path to vary the elevation of the image on the dome.

* * * * *